United States Patent [19]

Grzena

[11] Patent Number: 4,902,251

[45] Date of Patent: Feb. 20, 1990

[54] LAMP SOCKET TERMINAL

[75] Inventor: Karl R. Grzena, Niles, Ohio

[73] Assignee: General Motors Corporation, Detroit, Mich.

[21] Appl. No.: 406,194

[22] Filed: Sep. 13, 1989

Related U.S. Application Data

[63] Continuation of Ser. No. 289,896, Dec. 27, 1988, abandoned.

[51] Int. Cl.[4] ..... H01R 13/502

[52] U.S. Cl. ..... 439/699

[58] Field of Search ..... 439/699, 818, 845, 848, 439/851, 852, 858, 861, 862

[56] References Cited

U.S. PATENT DOCUMENTS

| | | | |
|---|---|---|---|
| 3,017,599 | 1/1962 | Loesch | 339/91 |
| 3,781,755 | 12/1973 | Pitacco | 339/14 R |
| 3,936,131 | 2/1976 | Durand | 339/128 |
| 3,999,095 | 12/1976 | Pearce, Jr. | 313/318 |
| 4,114,972 | 9/1978 | Kraus et al. | 339/65 |
| 4,181,390 | 1/1980 | Aizawa | 339/65 |
| 4,592,615 | 6/1986 | Durand | 339/176 L |
| 4,607,901 | 8/1986 | Durand | 339/59 L |
| 4,624,523 | 11/1986 | Durand | 339/176 L |
| 4,624,524 | 11/1986 | Durand | 339/176 L |
| 4,630,880 | 12/1986 | Durand | 339/176 L |
| 4,720,272 | 1/1988 | Durand | 439/375 |

*Primary Examiner*—Joseph H. McGlynn
*Attorney, Agent, or Firm*—F. J. Fodale

[57] ABSTRACT

A lamp socket assembly comprises a lamp bulb having a wedge base, a lamp socket and two electrical terminals. The electrical terminals have channel shaped receptacles which include spring contact arms which engage the contact wires of the lamp bulb and limit its insertion into the lamp socket. The receptacles also include spring detent arms to retain the wedge base in the terminals.

10 Claims, 3 Drawing Sheets

LAMP SOCKET TERMINAL

This is a continuation of application Ser. No. 289,896 filed on Dec. 27, 1988, now abandoned.

BACKGROUND OF THE INVENTION

This invention relates generally to electrical terminals and more specifically to electrical terminals for use in lamp sockets for lamp bulbs which have a wedge base.

Lamp bulbs having a wedge base have been known and used for some time. The wedge base of these lamp bulbs include a central vent tube bounded by laterally extending side wings. The lamp filament is energized by a pair of contact wires which extend out of the respective ends of the side wings and are bent over onto sides of the respective side wings which are on opposite sides of the wedge base. The other sides of the side wings have laterally extending troughs which are used to retain the lamp bulb in the lamp socket.

A common problem associated with such lamp bulbs is that the contact wires are often skewed or bent out of shape during handling resulting in poor or improper electrical contact when the lamp bulbs are inserted into the lamp sockets.

Various proposals have been made in the past to accommodate these skewed contact wires such as the terminals having a wire guide and straightening rib which are disclosed in U.S. Pat. No. 3,936,131 granted to Remie P. Durand on Feb. 3, 1976.

These past proposals also include lamp sockets having guide surfaces such as disclosed in U.S. Pat. No. 4,114,972 granted to Willibald Kraus et al on Sept. 19, 1978; terminals having spring members for straightening the contact wires such as disclosed in U.S. Pat. No. 4,181,390 granted to Masanobu Aizawa on Jan. 1, 1980; and terminals having redundant terminals as well as wire guides such as disclosed in U.S. Pat. No. 4,592,615 granted Remie Durand on June 3, 1986 and the following related patents of Remie Durand - U.S. Pat. No. 4,607,901; U.S. Pat. No. 4,624,523; U.S. Pat. No. 4,624,524; U.S. Pat. No. 4,630,880 and U.S. Pat. No. 4,720,272.

In all of these prior art patents the approach has been to reposition the skewed contact wire on the side surface of the side wing so that the terminal contact or contacts engage the repositioned contact wire against the side surface of the side wing.

SUMMARY OF THE INVENTION

The object of this invention is to provide an improved electrical terminal for use in lamp sockets for wedge base lamp bulbs which accommodate skewed contact wires of the lamp bulbs in a totally different manner which is simple and efficient.

A feature of the invention is that the improved electrical terminal has a contact which engages the contact wire at a place where the effects of a skewed contact wire are minimal.

Another feature of the invention is that the improved electrical connection has a contact which engages the contact wire against the end of the side wing from which the contact wire emerges where the effects of a skewed contact wire are minimal.

Still another feature of the invention is that the improved electrical terminal has a contact which incorporates a stop to limit the insertion of the lamp bulb so that the side wing is properly positioned in the terminal.

Other objects and features of the invention will become apparent to those skilled in the art as disclosure is made in the following detailed description of a preferred embodiment of the invention which sets forth the best mode of the invention contemplated by the inventor and which is illustrated in the accompanying sheet(s) of drawing.

DETAILED DESCRIPTION OF THE PREFERRED EMBODIMENT

Figure 1:
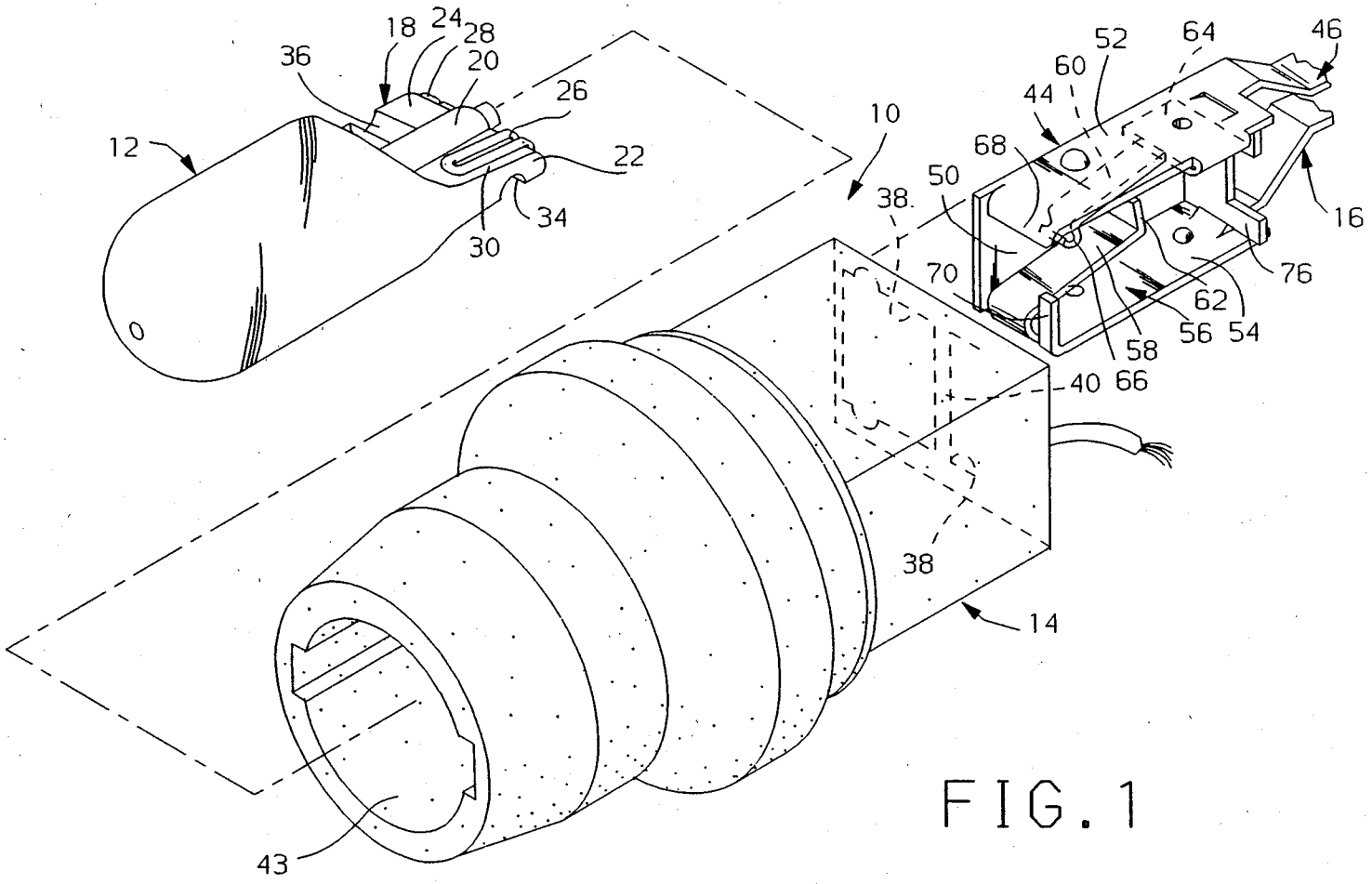
FIG. 1 is an exploded perspective view of a lamp socket assembly having electrical terminals in accordance with this invention.
Figure 2:
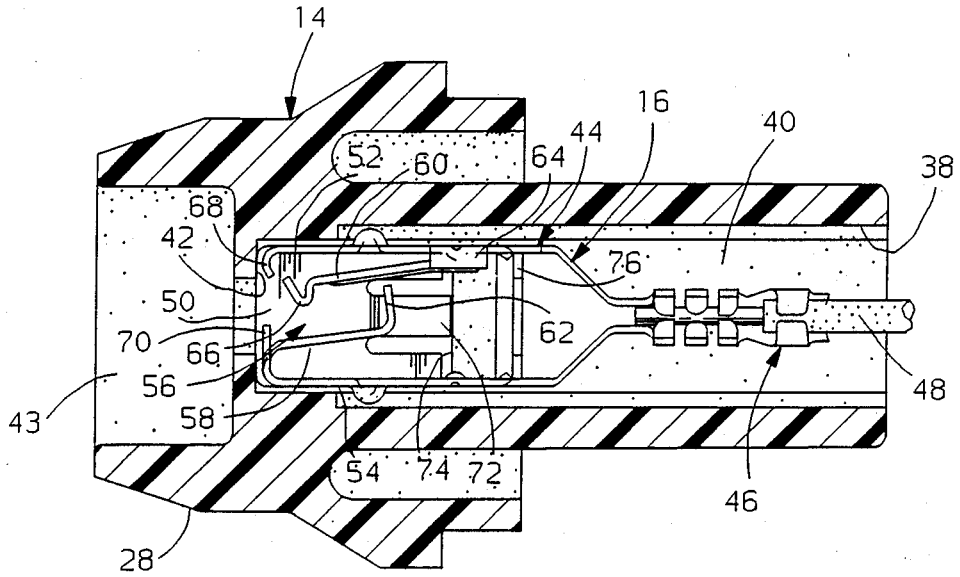
FIG. 2 is a longitudinal section of the lamp socket assembly shown in FIG. 1 prior to insertion of the lamp bulb.

Referring now to the drawing the lamp socket assembly 10 comprises a lamp bulb 12, a lamp socket 14 and two improved electrical terminals 16 in accordance with the invention.

Figure 4:
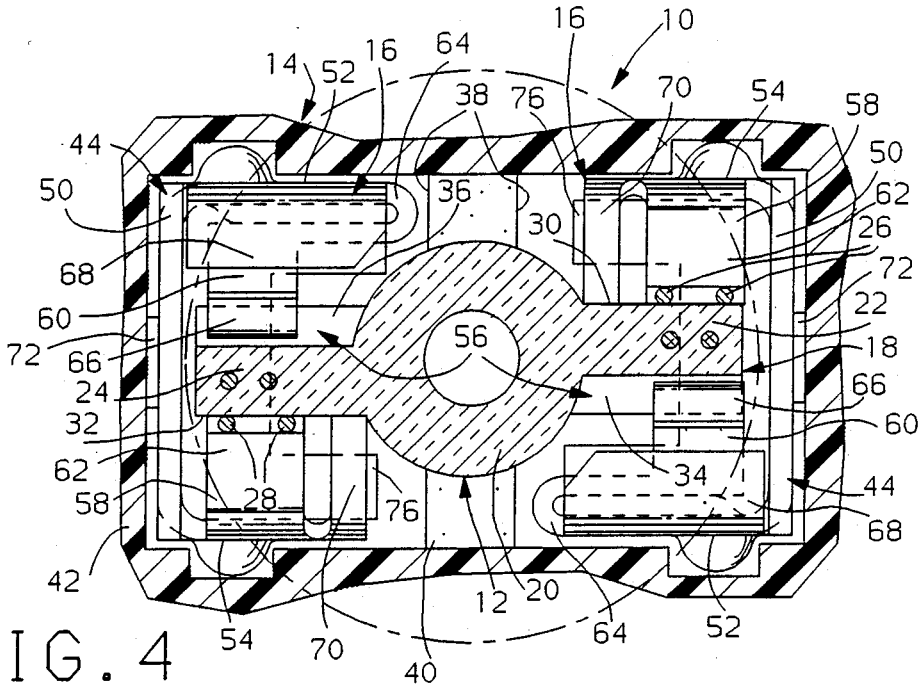
FIG. 4 is a section taken substantially along the line 4—4 of FIG. 3 looking in the direction of the arrows.

The lamp bulb 12 has a wedge base 18 which includes a central vent tube 20 bounded by laterally extending side wings 22 and 24. The filament (not shown) which is in the evacuated envelope of the lamp bulb is energized by a pair of contact wires 26 and 28 which extend out of the respective ends of the side wings 22 and 24. The emerging contact wires 26 and 28 are then bent over onto smooth sides 30 and 32 of the respective side wings which are on opposite sides of the wedge base 18 as best shown in FIG. 4. The other sides of the side wings 22 and 24, which are also on opposite sides of the wedge base 18, have laterally extending troughs 34 and 36 respectively.

The lamp socket 14, which is made from a thermoplastic or other suitable electrically insulative material, has a pair of terminal cavities 38 which are separated by a partition wall 40 in the conductor end of the lamp socket. The terminal cavities 38 open into a common medial cavity 42 which receives the wedge base 18 when the lamp bulb 12 is inserted in the socket 43 of the lamp socket 14 as shown in FIG. 4.

The improved electrical terminals 16 are identical and inserted into the terminal cavities 38 upside down with respect to each other as shown in FIG. 4. Each improved electrical terminal 16 comprises a receptacle portion 44 and an attachment portion 46 for attaching the terminal to an electrical conductor 48 in a conventional manner such as by conventional core and insulation crimp wings.

The receptacle portion 44 has a base wall 50 and side walls 52 and 54 which form a channel 56 for receiving one of the side wings 22 or 24 of the wedge base 18 when the lamp bulb 12 is inserted into the lamp socket 14. The receptacle portion 44 further includes a spring contact arm 58 and a spring detent arm 60.

The spring contact arm 58 is integrally connected to a forward edge of the side wall 54 in cantilever fashion and projects rearwardly into the interior of the channel 56. The spring contact arm 58 has an upright stop tab 62 at its free end which engages the contact wire 28 against the end of the side wing 24 from which the contact wire 28 emerges. The effects of a skewed wire are minimal at this location and thus stop tab 62 always establishes a good electrical contact with the contact wire 28. The stop tab 62 simultaneously limits the insertion of the side wing 24 so that it is properly positioned in the channel 56 of the terminal 16.

Figure 3:
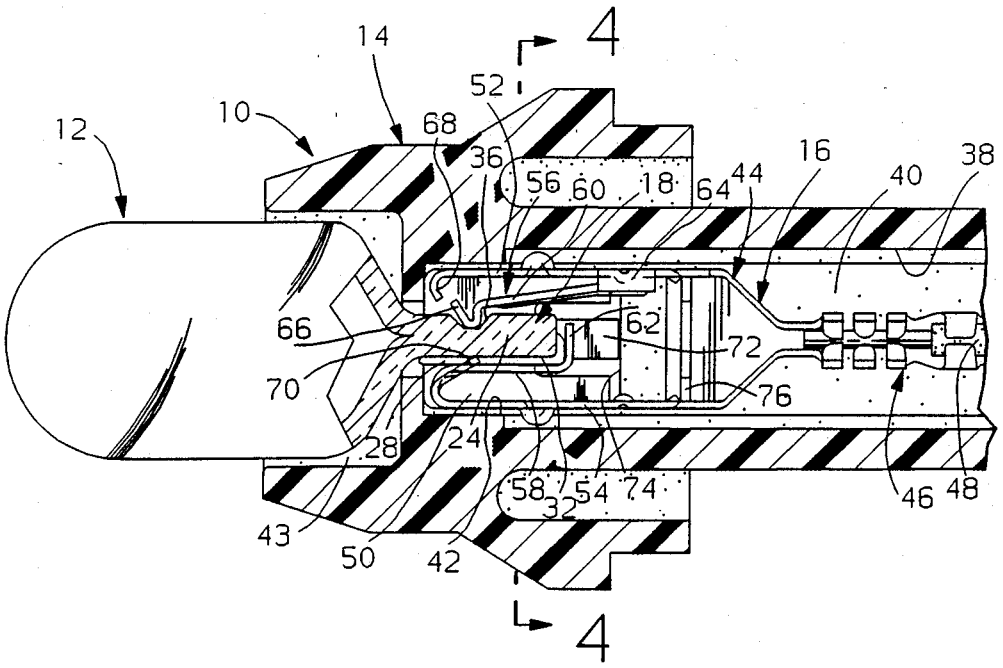
FIG. 3 is a longitudinal section of the lamp socket assembly shown in FIG. 1 after insertion of the lamp bulb.

The spring contact arm 58 is preferably flat and designed to engage the contact wire 28 against the smooth side 32 substantially along its entire length as shown in FIG. 3. This provides a redundant electrical contact between the terminal 16 and the contact wire 28. The base wall 50 provides a redundant electrical contact if the contact wire 28 is skewed laterally outwardly of the side wing 24.

The spring detent arm 60 is integrally connected to the side wall 52 of the channel 56 in cantilever fashion via a folded tab 64 and projects forwardly into the interior of the channel 56. The spring detent arm has a detent 66 at its free end to engage the laterally extending trough 36 in the upper side of the side wing 24 (as viewed in FIGS. 1, 3 and 4) and retain the lamp bulb 12. There is a curved bulb guide 68 at the forward edge of the side wall 52 to prevent insertion of the side wing 24 or other foreign substances into the space between the side wall 52 and the free end of the spring detent.

The receptacle portion 44 also includes a wire guide 70 which is cantilevered from the forward edge of the side wall 54 so that the spring contact arm 58 is between the wire guide 70 and the base wall 50. The wire guide 70 projects into the interior of the channel 50 so that it wipes along the smooth side 32 of the side wing 24 when it is inserted into the channel 56 of the terminal 16 so as to urge the contact wire 26 away from the vent tube 20 if the contact wire 26 is skewed toward the vent tube. This will prevent even the remotest possibility of the contact wire crossing over the vent tube and short circuiting with the other terminal.

The base wall 50 has a latch finger 72 which is cut out from the base wall 50 and inclined outwardly of the channel 56 in the rearward direction. This latch finger 72 cooperated with a latch shoulder 74 in the terminal cavity 38 to retain the terminal 16 in the terminal cavity. The base wall 50 also has a support tab 76 which is cut out from the base wall 50 rearwardly of the latch finger 72 and bent perpendicularly into the channel 56 to engage the side walls 52 and 54 and enhance the rigidity to the channel 56.

As indicated above the second terminal 16 is identical and used in an upside down relationship as shown in FIG. 4. The second terminal 16 cooperates with the side wing 22 in the same way to establish electrical contact with the contact wire 26.

Figure 5:
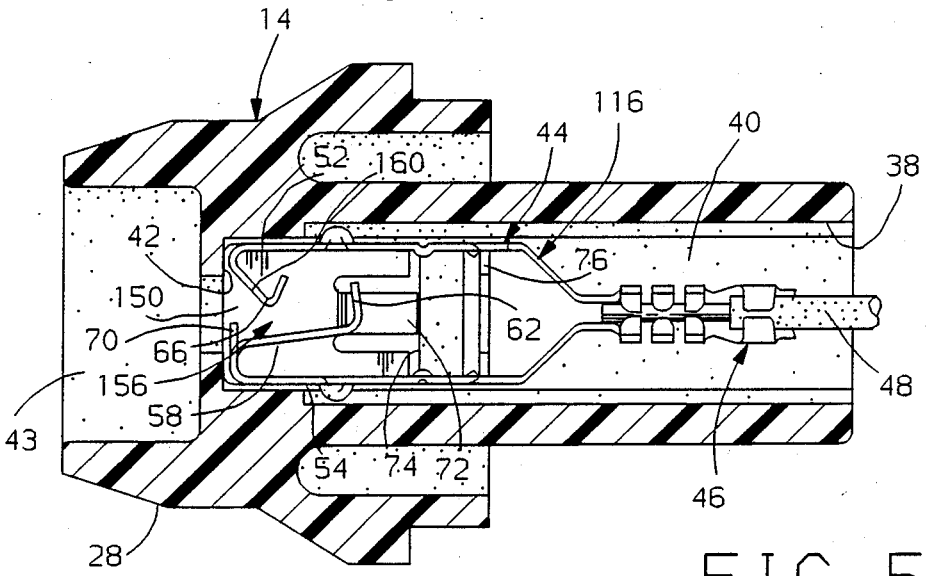
FIG. 5 is a longitudinal section of a lamp socket assembly having a modified electrical terminal.

FIG. 5 shows a modified terminal 116 for the lamp socket 14. The modified terminal has a spring detent arm 160 which is integrally connected to the front edge of the side wall 150 of the channel 156 in cantilever fashion and projects inwardly into the interior of the channel 156. This eliminates the need for the curved bulb guide 68. The rest of the terminal 116 is the same as the terminal 16. The modified terminal 116 provides a more rigid lamp bulb retention due to the shortness of the spring detent arm 160.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion having a base wall and side walls forming a channel for receiving one side wing of the wedge base of the lamp bulb;

a spring contact arm integrally connected to a forward edge of one side wall of the channel in cantilever fashion and projecting rearwardly into the interior of the channel to engage a contact wire extending out of the end of the one side wing of the wedge base, and a spring detent arm integrally connected to the other side wall of the channel and projecting inwardly to engage a trough in the one side wing of the wedge base for lamp bulb retention.

2. The terminal as defined in claim 1 wherein:

the spring contact arm has a stop at its free end which engages the contact wire against the end of the one side wing and limits insertion of the one side wing into the channel, and the spring contact arm has a flat portion designed to engage the contact wire substantially along its entire length to provide a redundant electrical contact between the terminal and the contact wire.

3. The terminal as defined in claim 2 wherein:

the spring detent arm is integrally connected to the other side wall of the channel via a folded tab and projects forwardly into the interior of the channel.

4. The terminal as defined in claim 2 wherein:

the spring detent arm is integrally connected to a forward edge of the other side wall of the channel and projects rearwardly into the interior of the channel.

5. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion and an attachment portion for attaching the terminal to an electrical conductor;

the receptacle portion having a base wall and side walls forming a channel for receiving one side wing of the wedge base of the lamp bulb;

a spring contact arm integrally connected to a forward edge of one side wall of the channel in cantilever fashion and projecting rearwardly into the interior of the channel to engage a contact wire extending out of the end of the side wing of the wedge base, said contact arm having a stop at its free end which limits insertion of the one side wing into the channel, a spring detent arm integrally connected to the other side wall of the channel and projecting into the interior of the channel to engage a trough in the one side wing of the wedge base, and a wire guide which is cantilevered from the forward edge of the one side wall so that the spring contact arm is between the wire guide and the base wall, said wire guide projecting into the interior of the channel so that it wipes along the first side of the one side wing when it is inserted into the channel of the terminal so as to urge the contact wire away from the vent tube if the contact wire is skewed toward the vent tube.

6. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion and an attachment portion for attaching the terminal to an electrical conductor;

the receptacle portion having a base wall and side walls forming a channel for receiving one side wing of the wedge base of the lamp bulb;

a spring contact arm integrally connected to a forward edge of one side wall of the channel in cantilever fashion and projecting rearwardly into the interior of the channel to engage a contact wire extending out of the end of the one side wing of the wedge base, said spring contact arm having an upright stop tab at its free end which engages the end of the stop wing to limit insertion of the one side wing into the channel of the terminal, a spring detent arm integrally connected to the other side wall of the channel in cantilever fashion via folded tab and projecting forwardly into the interior of the channel, said spring detent arm having a detent at its free end to engage the laterally extending trough in the second side of the one side wing of the wedge base, a curved bulb guide at the forward edge of the other side wall of the channel to prevent insertion of the one side wing into the space between the other side wall and the free end of the spring detent arm, and a wire guide which is cantilevered from the forward edge of the one side wall so that the spring contact arm is between the wire guide and the base wall, said wire guide projecting into the interior of the channel so that it wipes along the first side of the side wing when it is inserted into the channel of the terminal so as to urge the contact wire away from the vent tube if the contact wire is skewed toward the vent tube.

7. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion having a base wall and side walls forming a channel for receiving one side wing of the wedge base of the lamp bulb;

a spring contact arm integrally connected to a forward edge of one side wall of the channel in cantilever fashion and projecting rearwardly into the interior of the channel;

said contact arm having an angularly disposed tab at its free end to engage a contact wire extending out of the end of the side wing of the wedge base, and a spring detect arm integrally connected to the other side wall of the channel and projecting inwardly to engage a trough in the one side wing of the wedge base.

8. The terminal as defined in claim 7 wherein:

the angularly disposed tab is upright and forms a stop at the free end of the spring contact arm which engages the contact wire against the end of the one side wing and limits insertion of the one side wing into the channel.

9. The terminal as defined in claim 8 wherein:

the spring detent arm is integrally connected to the other side wall of the channel via a folded tab and projects forwardly into the interior of the channel.

10. The terminal as defined in claim 8 wherein:

the spring detent arm is integrally connected to a forward edge of the other side wall of the channel and projects rearwardly into the interior of the channel.

* * * * *